US007377055B2

(12) United States Patent
Bramani

(10) Patent No.: US 7,377,055 B2
(45) Date of Patent: May 27, 2008

(54) SOLE FOR SHOES PARTICULARLY FOR PRACTICING SPORTS

(75) Inventor: Marco Bramani, Albizzate (IT)

(73) Assignee: Vibram S.p.A., Albizzate (Varese) (IT)

( * ) Notice: Subject to any disclaimer, the term of this patent is extended or adjusted under 35 U.S.C. 154(b) by 179 days.

(21) Appl. No.: 11/142,294

(22) Filed: Jun. 2, 2005

(65) Prior Publication Data

US 2005/0278979 A1 Dec. 22, 2005

(30) Foreign Application Priority Data

Jun. 16, 2004 (IT) ..... MI20040295 U

(51) Int. Cl.
*A43C 13/36* (2006.01)
*A43B 5/00* (2006.01)

(52) U.S. Cl. ..... 36/15; 36/131; 36/73

(58) Field of Classification Search ..... 36/71.5, 36/15, 131, 73, 127
See application file for complete search history.

(56) References Cited

U.S. PATENT DOCUMENTS 297,150 A * 4/1884 Mehew ..... 36/73
570,707 A * 11/1896 McKay ..... 36/71.5
3,934,359 A * 1/1976 Fletcher ..... 36/73
4,073,075 A * 2/1978 O'Brien ..... 36/127
4,184,273 A 1/1980 Boyer et al.
4,866,861 A * 9/1989 Noone ..... 36/127
6,195,920 B1 3/2001 Morris et al.

FOREIGN PATENT DOCUMENTS

DE 36 43 057 A1 6/1988
EP 1 554 943 A 7/2005
FR 2 841 105 A 12/2003
GB 2 363 969 A 1/2002

* cited by examiner

*Primary Examiner*—Ted Kavanaugh
(74) *Attorney, Agent, or Firm*—Jacobson Holman PLLC

(57) ABSTRACT

A sole for shoes, particularly for practicing sports, including a sole body that forms, at at least one perimetric portion, a recessed region for detachably accommodating at least one pad, which is provided with a first wing that overlaps the recessed region and with a second wing that forms a lateral rising portion that can be arranged so as to protect an outer profile of the shoe.

7 Claims, 4 Drawing Sheets

SOLE FOR SHOES PARTICULARLY FOR PRACTICING SPORTS

The present invention relates to a sole for shoes particularly for practicing sports.

BACKGROUND OF THE INVENTION

As is known, shoes are already commercially available which are used for sports and have, at the surface of the sole, pads that are interchangeable because they can be subject to wear.

These solutions have failed to prove to be valid in the case of particular sports, such as for example supermotard and motocross, in which the sole of the shoe, which is constituted by a boot, is subject to extremely intense wear especially along the outer perimetric line.

Particularly in supermotard, where racing occurs substantially on tarmac-covered surfaces, the racers use the boot as a third supporting point to stabilize the motorcycle along bends, with the result of literally destroying the rubber sole during a single race and of also damaging the lateral portion of the upper of the shoe.

SUMMARY OF THE INVENTION

The aim of the invention is to solve the problem described above by providing a sole for shoes, particularly for practicing sports such as for example supermotard and motocross, that allows to have pads that can perform a protective action also with respect to the upper and can ensure a calibrated grip that is sufficient to avoid slipping during contact but is not as excessive as to cause dangerous torsions of the boot.

Within this aim, an object of the invention is to provide a sole in which it is possible to apply rapidly and easily pads that can be modified in each instance depending on the particular needs, thus allowing the user to adapt the boot to the various conditions of the track and to preserve the boot and walk easily during breaks and during trackside transfers.

Another object of the present invention is to provide a sole that thanks to its particular constructive characteristics is capable of giving the greatest assurances of reliability and safety in use.

Another object of the present invention is to provide a sole for shoes, particularly for practicing sports, that can be easily obtained starting from commonly commercially available elements and materials and is further competitive from a merely economical standpoint.

This aim and these and other objects that will become better apparent hereinafter are achieved by a sole for shoes particularly for practicing sports, according to the invention, characterized in that it comprises a sole body that forms, at at least one perimetric portion, a recessed region for detachably accommodating at least one pad, which is provided with a first wing that overlaps said recessed region and with a second wing that forms a lateral rising portion that can be arranged so as to protect the outer profile of the shoe.

BRIEF DESCRIPTION OF THE DRAWINGS

Further characteristics and advantages of the present invention will become better apparent from the detailed description of a sole for shoes particularly for practicing sports, illustrated by way of non-limiting example in the accompanying drawings, wherein.

DESCRIPTION OF THE PREFERRED EMBODIMENTS

Figure 1:
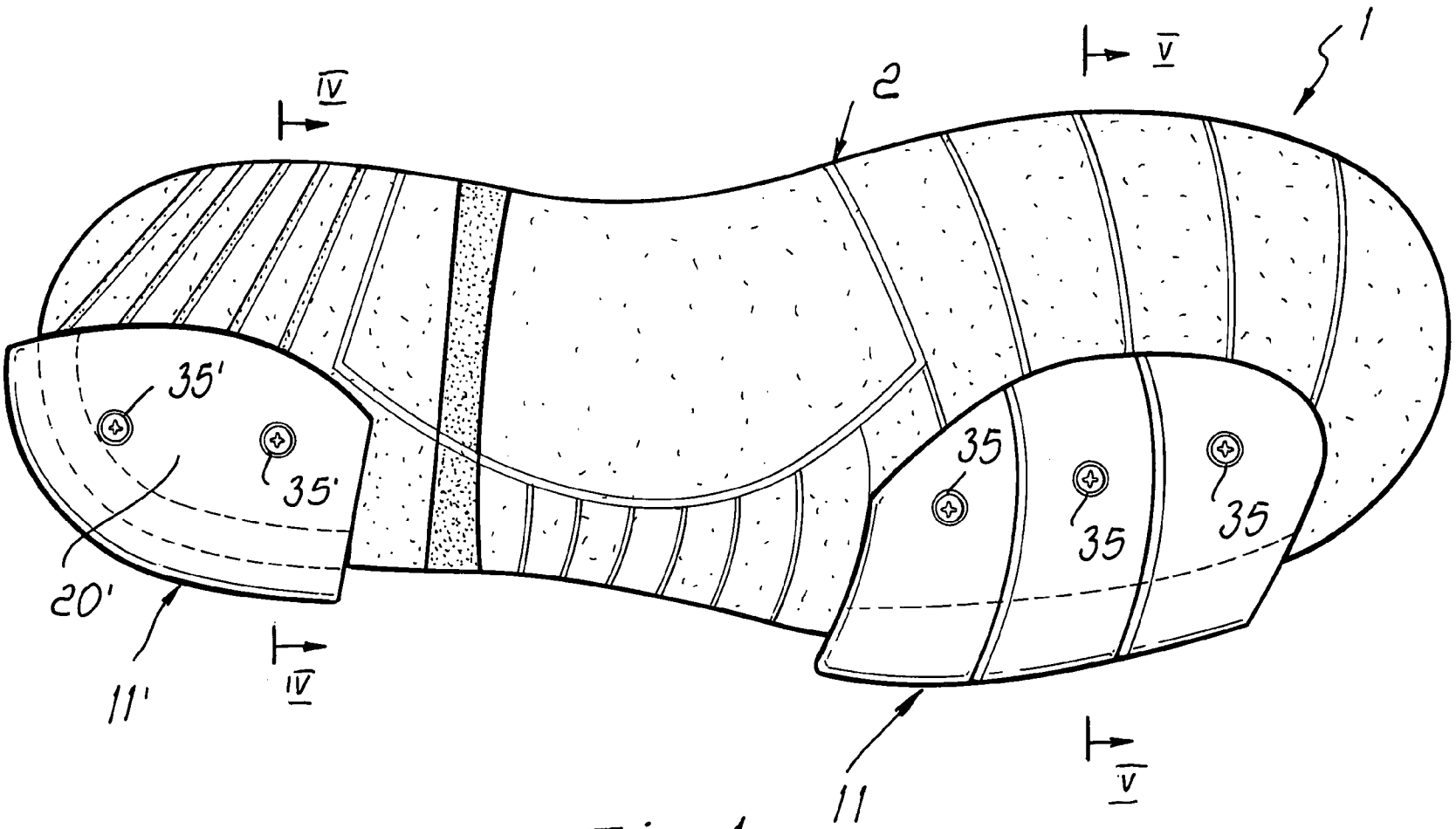
FIG. 1 is a plan view of the sole according to the invention, taken from its lower face.
Figure 2:
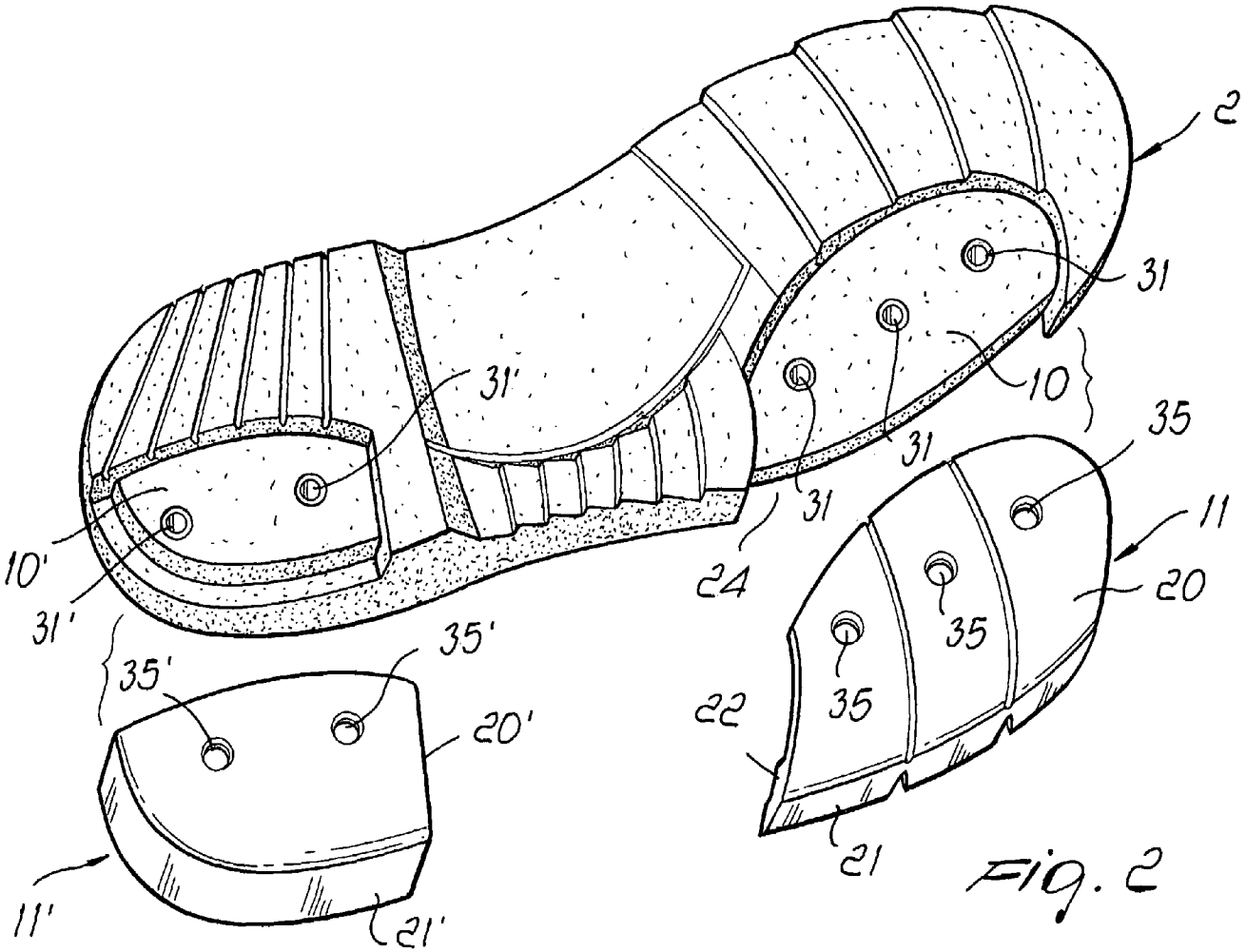
FIG. 2 is a perspective view of the sole, taken from its lower face, with the pads shown in exploded view.
Figure 3:
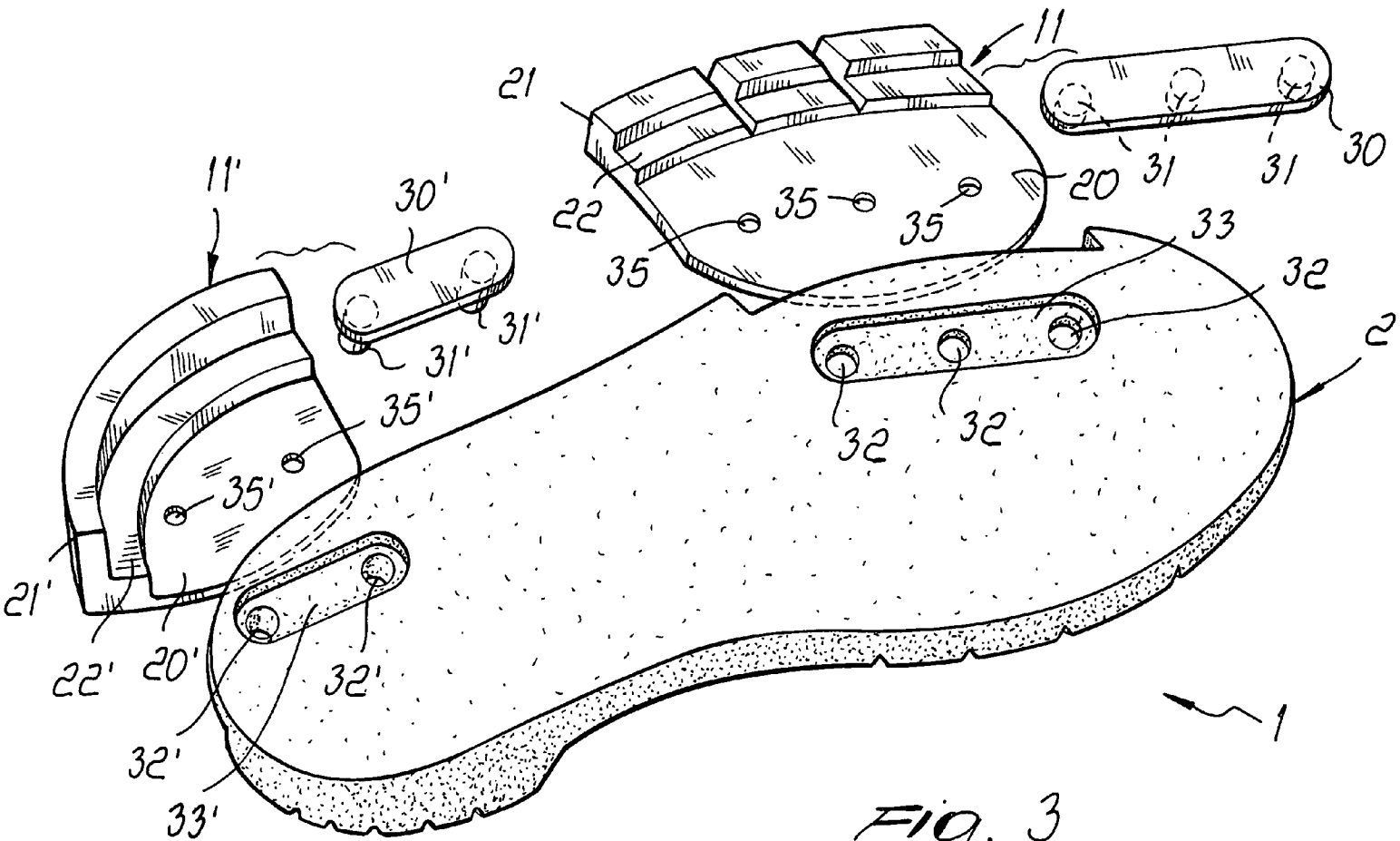
FIG. 3 is a perspective view of the sole, taken from its upper face, with the pads shown in exploded view.
Figure 4:
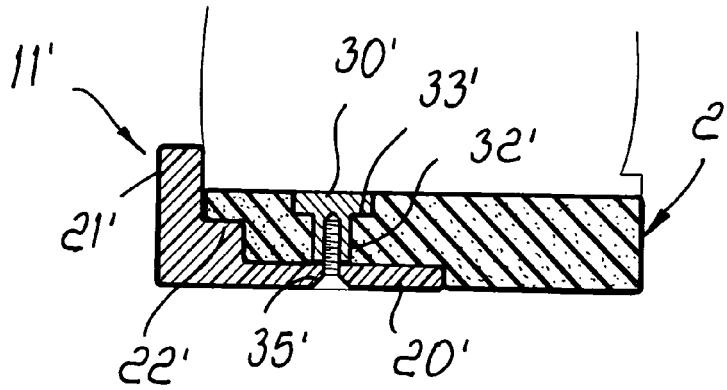
FIG. 4 is a schematic sectional view, taken along the line IV-IV of FIG. 1.

With reference to the figures, the sole for shoes particularly for practicing sports, according to the invention, generally designated by the reference numeral 1, comprises a sole body 2, which can be shaped in any manner and has, at the outer part of the plantar region, a recessed region 10 for detachably accommodating at least one pad 11, which can be arranged in the recessed region 10 by way of connection means described in greater detail hereinafter.

An important feature of the invention consists in that the pad 11 is provided with a first wing 20, which overlaps the recessed region 10 and is connected to a second wing 21, which rises laterally with respect to the sole so as to provide a lateral protection, as will become better apparent hereinafter.

Moreover, in the corner region, i.e., in the region that connects the first wing 20 and the second wing 21, there is a step-like expansion 22, which is located internally and arranges itself at a recess 24 that is laterally adjacent to the recessed region 10.

The means for fixing the pad have a contrast plate 30, which is provided with bushes 31 that are optionally applied and made of metallic material and enter holes 32 provided at a recess 33 formed correspondingly on the upper face of the sole body 2.

The first wing 20 forms flared holes 35, in which it is possible to insert a fixing screw, the head whereof is adequately protected in order to rapidly fix the pad 10 at the central region.

As shown in the drawing, it is possible to provide an additional pad, designated by the reference numeral 11', constituted by a first wing 20' and by a lateral wing 21', which is accommodated in a rear recessed region, which is designated by the reference numeral 10' and is provided at the outer lateral part of the heel region.

Figure 5:
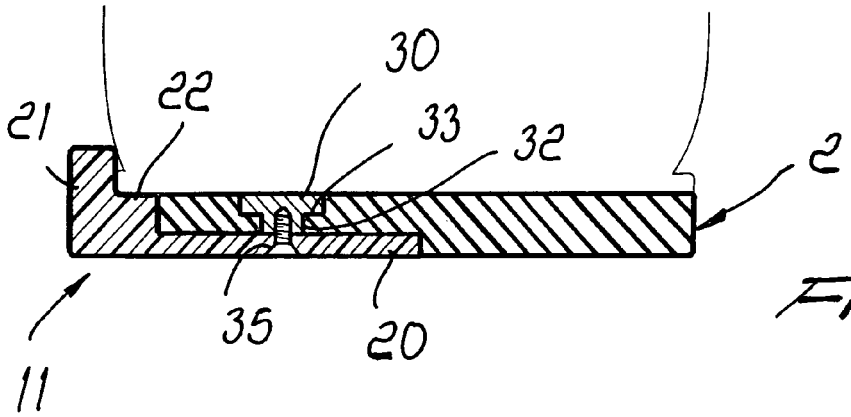
FIG. 5 is a schematic sectional view, taken along the line V-V of FIG. 1.

Correspondingly, as shown in the cross-section of FIG. 5, the pad 11' has a step-like expansion 22', which is provided in the region connecting the wing 20' and the lateral wing 21'.

A fixing means is also provided, which is constituted by a rear contrast plate 30', provided with bushes 31', which enter holes 32' formed in a hollow or recess 33' provided correspondingly in the sole.

In this case also, the pads pass through flared holes 35' provided in the wing 20'.

With the described arrangement, it is possible to use pads in which the first wing has a relatively low thickness, typically comprised between 3 and 7 mm, which especially for application at the plantar region allow to leave a certain sensitivity for changing gears, while on the lateral wing, where greater protection is required, the thickness rises to 6-12 mm, and at the perimetric edge region, where there is an internal expansion 22 or 22', the diagonal depth reaches 15-20 mm.

Figure 6:
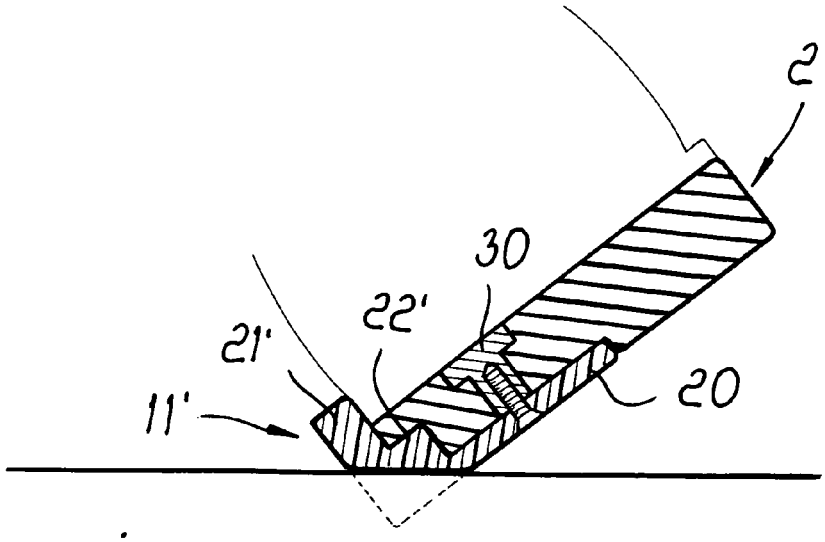
FIG. 6 is a schematic sectional view of the wear of the pads during sports practice.

It should be noted that this is the edge where maximum wear occurs, as shown schematically in FIG. 6, since the foot is placed on the ground at an angle, and therefore it is necessary to have a greater thickness of material at the contact regions that are subjected to the most intense wear.

The interchangeable pads can be made of rigid or elastomeric thermoplastic or thermosetting polymers.

Rigid thermoplastic polymers, which are constituted for example by polyamides, polyolefins, acetal resins, are preferably used for racing on a dry track, where the grip required is not excessive and indeed a certain tendency to slip on tarmac is preferable, and can be reinforced with variable quantities of fibers, such as glass, carbon, Kevlar and other fibers, in order to limit their wear and increase their durability.

The elastomeric polymers can be thermosetting, such as for example vulcanized rubbers (SBR, NR, BR, NBR, chlorinated rubbers and so forth), or thermoplastic, such as polyurethane elastomers, and are used preferably on wet tracks, where higher grip is instead required.

From what has been described above, it is thus evident that the invention achieves the intended aim and objects, and in particular the fact is stressed that pads are used which are studied so as to give adequate protection especially at the lateral edge, where the pad has a greatly increased thickness, which constitutes a protective element for the shoe.

From what has been described above, it is thus evident that the sole according to the invention allows the user to adapt the boot to the various conditions of the track and to preserve the boot by replacing the pads easily and autonomously, and further allows the user to walk easily during breaks and trackside transfers.

In practice, the materials used, so long as they are compatible with the specific use, as well as the contingent shapes and dimensions, may be any according to requirements.

The disclosures in Utility Model Application No. MI2004U000295 from which this application claims priority are incorporated herein by reference.

What is claimed is:

1. A sole for shoes used for practicing sports, said sole comprising a sole body having an upper surface, a lower surface and at least one perimetric portion, a recessed region of the sole body, at least one pad detachably accommodated in said recessed region, said at least one pad including a first wing overlapping said recessed region and a second wing forming a lateral rising portion arranged to protect an outer profile of the sole body beyond the at least one perimetric portion, and an upper surface of said pad including a step-like expansion between said first wing and said second wing, said step-like expansion extending in a direction from an interior of the sole body towards the at least one perimetric portion to provide an increased thickness of said pad at angled contact regions subjected to most intense wear.

2. The sole according to claim 1, comprising means for detachably fixing said at least one pad to said sole body.

3. The sole according to claim 2, wherein said detachably fixing means comprise a contrast plate, which is provided with bushes that can be inserted in holes provided at a recess provided correspondingly in an upper face of said sole body, fixing screws engaging said bushes and having a head that can be inserted in a flared portion of holes provided in the first wing of said pad.

4. The sole according to claim 1, wherein said pad is arranged at an outer side of a central region of the sole of the user's foot.

5. The sole according to claim 1, further comprising another pad provided at a lateral and rear portion of the heel of said sole body.

6. The sole according to claim 1, wherein said pad is made of rigid thermoplastic polymers.

7. The sole according to claim 1, wherein said pad is made of thermoplastic or thermosetting elastomeric polymers.

* * * * *